US008113441B2

(12) United States Patent
Urmson, Jr. et al.

(10) Patent No.: US 8,113,441 B2
(45) Date of Patent: Feb. 14, 2012

(54) LAP JOINT

(75) Inventors: W. Thomas Urmson, Jr., Valencia, PA (US); John W. Mospan, Pittsburgh, PA (US); James A. Remington, Sheffield Village, OH (US)

(73) Assignee: Koppers Delaware, Inc., Wilmington, DE (US)

( * ) Notice: Subject to any disclaimer, the term of this patent is extended or adjusted under 35 U.S.C. 154(b) by 674 days.

(21) Appl. No.: 11/900,635

(22) Filed: Sep. 12, 2007

(65) Prior Publication Data

US 2008/0083836 A1 Apr. 10, 2008

Related U.S. Application Data

(60) Provisional application No. 60/844,774, filed on Sep. 15, 2006.

(51) Int. Cl.
*E01B 11/00* (2006.01)

(52) U.S. Cl. ..... 238/153

(58) Field of Classification Search ..... 238/152, 238/153, 167, 173, 175, 185, 186, 195, 221, 238/225, 230, 231
See application file for complete search history.

(56) References Cited

U.S. PATENT DOCUMENTS 1,237,982 A * 8/1917 Wellendorf ..... 238/152
2,209,725 A * 7/1940 Bourland ..... 238/167
2,305,843 A * 12/1942 Chagnon ..... 238/230
3,499,604 A * 3/1970 Nelson ..... 238/230
3,727,838 A * 4/1973 Bergh ..... 238/152
4,171,774 A * 10/1979 Deslauriers ..... 238/171
4,209,130 A * 6/1980 Sundsrud et al. ..... 238/152
4,637,578 A * 1/1987 Frank ..... 246/391
5,503,331 A 4/1996 Uramson, Jr. et al.

OTHER PUBLICATIONS

Davis et al., "Prototype Next Generation Insulated Joints", Technology Digest, Mar. 2010, TD-10-009, Transportation Technology Center, Inc.
Akhtar et al., "Development of and Improved Performance Bonded Insulated Joint for HAL Service", Technology Digest, May 2006, TD-06-012, Transportation Technology Center, Inc.
Davis et al., "Analysis of Conventional and Tapered Bonded Insulated Rail Joints", Technology Digest, May 2006, TD-06-014, Transportation Technology Center, Inc.
Akhtar et al., "Preliminary Results of Prototype Insulated Joint Tests at FAST", Technology Digest, May 2007, TD-07-013, Transportation Technology Center, Inc.
Davis et al., "Evaluation of Improved Designs for Bonded Insulated Joints in HAL Service", Technology Digest, Jul. 2007, TD-07-020, Transportation Technology Center, Inc.

* cited by examiner

*Primary Examiner* — Joe Morano, IV
*Assistant Examiner* — R. J. McCarry, Jr.
(74) *Attorney, Agent, or Firm* — The Webb Law Firm

(57) ABSTRACT

A lap joint assembly that includes two spaced apart mating railroad end sections that are double bent and machine tapered and trimmed to conform in spatial alignment with one another, an electrical insulating material positioned between the two machined mating rail sections and at least one fastener attaching the machined railroad rail sections to one another.

27 Claims, 12 Drawing Sheets

LAP JOINT

CROSS REFERENCE TO RELATED APPLICATION

This application claims the benefit of U.S. Provisional Application No. 60/844,774 entitled "Lap Joint," filed on Sep. 15, 2006, which is hereby incorporated by reference.

BACKGROUND OF THE INVENTION

1. Field of the Invention

The present invention relates to the method and apparatus for electrically isolating two adjoining railroad rail sections together and, more particularly, to providing joined insulated rails that are machined.

2. Description of Related Art

The rail system, which permits more than one train to travel on one stretch of track of rail, is generally divided into sections or blocks. The purpose of dividing railroad rails of a rail system into sections is to detect the presence of a train on a section of rail at any given time. Each rail section is electrically isolated from all other sections so that a high electrical resistance can be measured over the rail section when no train is present in that section. When a train enters a rail section, the train will short circuit adjacent railroad rails in which the electrical resistance in the rail section drops thereby indicating the presence of a train.

Railroad rails are generally welded to each other or attached to each other by a steel joint. FIG. 1 shows a typical prior art railroad rail 10 that includes a body 12 having a first side 14 and a second side 16 and defines a head section 18, a web section 22 and a base section 26. The head section 18 having a top surface 20 is connected to the web section 22, which is connected to the base 26. The web section 22 defines at least one slot 24 (shown in phantom) for receiving fasteners.

In order to electrically isolate adjacent rail sections of a rail system, high-performance, non-metallic joints or steel joints having electrically insulated material bonded to its surface are typically used in conjunction with electrically-insulating material placed between abutting ends of joined railroad rails.

FIG. 2 shows a prior art rail joint assembly 30 that includes a first railroad rail 32 having an abutting end 33 and a second railroad rail 34 having an abutting end 35. The ends 33, 35 of the respective railroad rails 32, 34 are joined to each other and a rail joint bar 36 is used to hold the two ends 33, 35 in place. A plurality of holes 38 are defined in the rail joint bar 36, where the holes 38 are adapted to receive fasteners, such as a nut and bolt arrangement (not shown), for securing the rail joint bar 36 to the railroad rails 32, 34. Electrically-insulating material 40, such as polyurethane, is sandwiched between the rail ends 33, 35 to insulate the railroad rails 32, 34 from each other. However, over time the rail wheels will cause the rail ends 33, 35 to deform and/or break apart (referred to in the industry as end batter E shown in FIG. 2), thus causing the railroad rails 32, 34 to contact each other and short out.

FIG. 3 shows a prior art rail joint arrangement 42 that addresses the problems of deformation and end batter of adjoining insulated railroad rails. Like reference numerals are used for like parts. The arrangement 42 includes two joined railroad rails 32, 34 that have been machine cut, tapered and trimmed to compliment one another (collectively known in the industry as a "Z Cut"). This arrangement 42 spreads the impact load of the train wheels over a longer area thus increasing the Moment of Inertia at a section where the railroad rails 32, 34 are joined. Although the arrangement 42 has a high Moment of Inertia, which can be defined as the capacity of a cross-section to resist bending, this arrangement 42 utilizes non-standard railroad rails having a double thick web section 22 (not shown), such that non-standard rail joint bars have to be used when attaching the railroad rails 32, 34 to each other. The use of non-standard railroad rails and rail joint bars increases the cost for the arrangement 42. The electrically-insulating material 40 has uniform thickness throughout its length and insulates from the top to the bottom of the adjacent railroad rails 32, 34.

It is, therefore, an object of the present invention to eliminate the above-mentioned deficiencies by providing a high strength lap joint assembly that utilizes standard railroad rails and other off-the-shelf rail products for electrically isolating two adjoining railroad rail end sections to each other. It is a feature of the present invention to eliminate end batter and to provide a lap joint assembly that is substantially as stiff as a solid railroad rail. It is another feature of the present invention to use bonded rail joints and an adhesive such as an epoxy between the adjoining rail end sections thus increasing the longitudinal bond strength of the lap joint assembly.

SUMMARY OF THE INVENTION

The present invention provides for a lap joint assembly wherein rail end sections of two adjoining railroad rails are machine tapered and trimmed and a method of making the same. The lap joint assembly includes two spaced apart mating railroad rails that are double bent and machine tapered and trimmed to conform in spatial alignment with one another, an electrically-insulating material positioned between the two machined mating railroad rails, and a rail joint bar used for attaching the railroad rail to one another via fasteners.

DETAILED DESCRIPTION OF THE INVENTION

Figure 1:
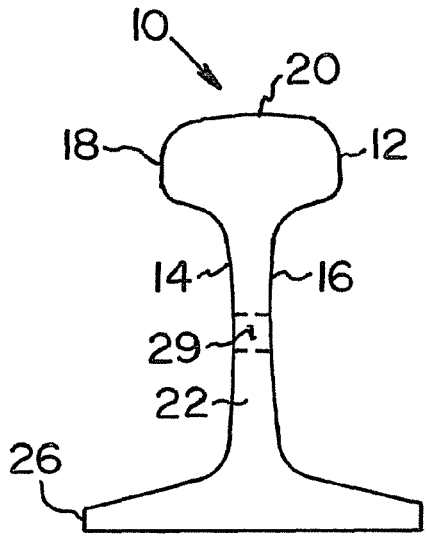
FIG. 1 (PRIOR ART)
FIG. 1 is a front elevational view of a typical prior art railroad rail.

For purposes of the description hereinafter, the words "upward" and "downward", and like spatial terms, if used, shall relate to the described embodiments as oriented in the drawing figures. However, it is to be understood that many alternative variations and embodiments may be assumed except where expressly specified to the contrary. It is also to be understood that the specific devices and embodiments illustrated in the accompanying drawings and described herein are simply exemplary embodiments of the invention.

Figure 4:
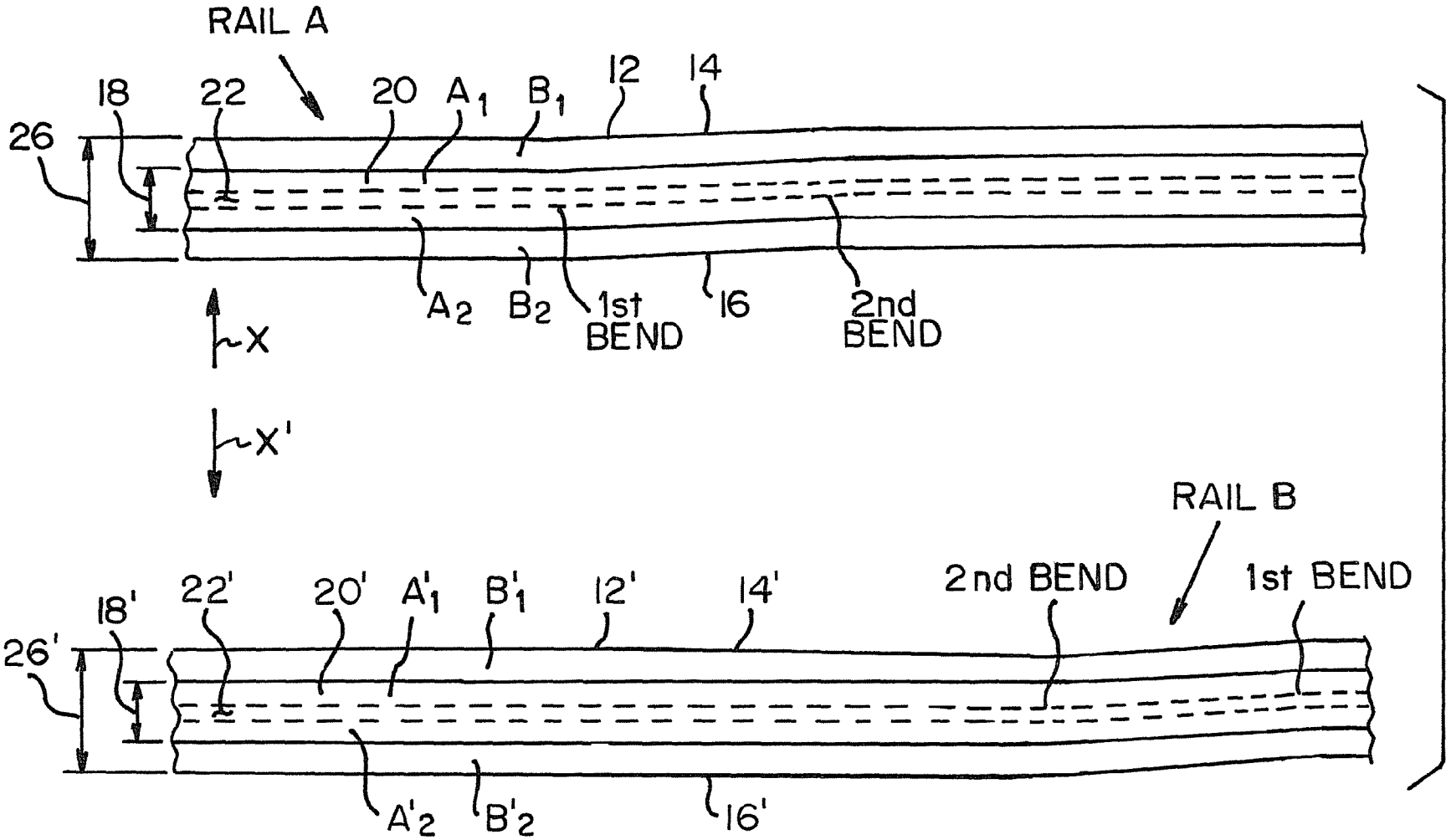
FIG. 4 is a is top plan view of mating railroad rails, Rails A and B, after bending.

FIG. 4 shows mating railroad rail sections, Rails A and B, in a bent position. Rails A and B can be any size or type of standard tee railroad rail 10 as shown in FIG. 1, such as 132-RE, 136-RE and 141-RE rails according to the American Railway Engineering and Maintenance-of-Way Association (AREMA) specifications. Like reference numerals are used for like parts. Referring to FIG. 4, Rail A includes a body 12 having a first side 14 and a second side 16 and defining a head section 18, a web section 22 connected to the head section 18, and a base section 26 connected to the web section 22. The web section 22 is shown in phantom by dashed lines. The head section 18 having a top surface 20 includes a first head portion $A_1$ and a second head portion $A_2$, and the base section 26 includes a first base portion $B_1$ and a second base portion $B_2$ on each side 14, 16, respectively, of Rail A. Rail B, which is a mirror image of Rail A, has a body 12' with a first side 14 and a second side 16 and includes a head section 18' having a top surface 20' and defining a first head portion $A_1'$ and a second head portion $A_2'$, a base section 26' having a first base portion $B_1'$ and a second base portion $B_2'$ and a web section 22' defined therebetween. The web section 22' is also shown in phantom by dashed lines.

Figure 5:
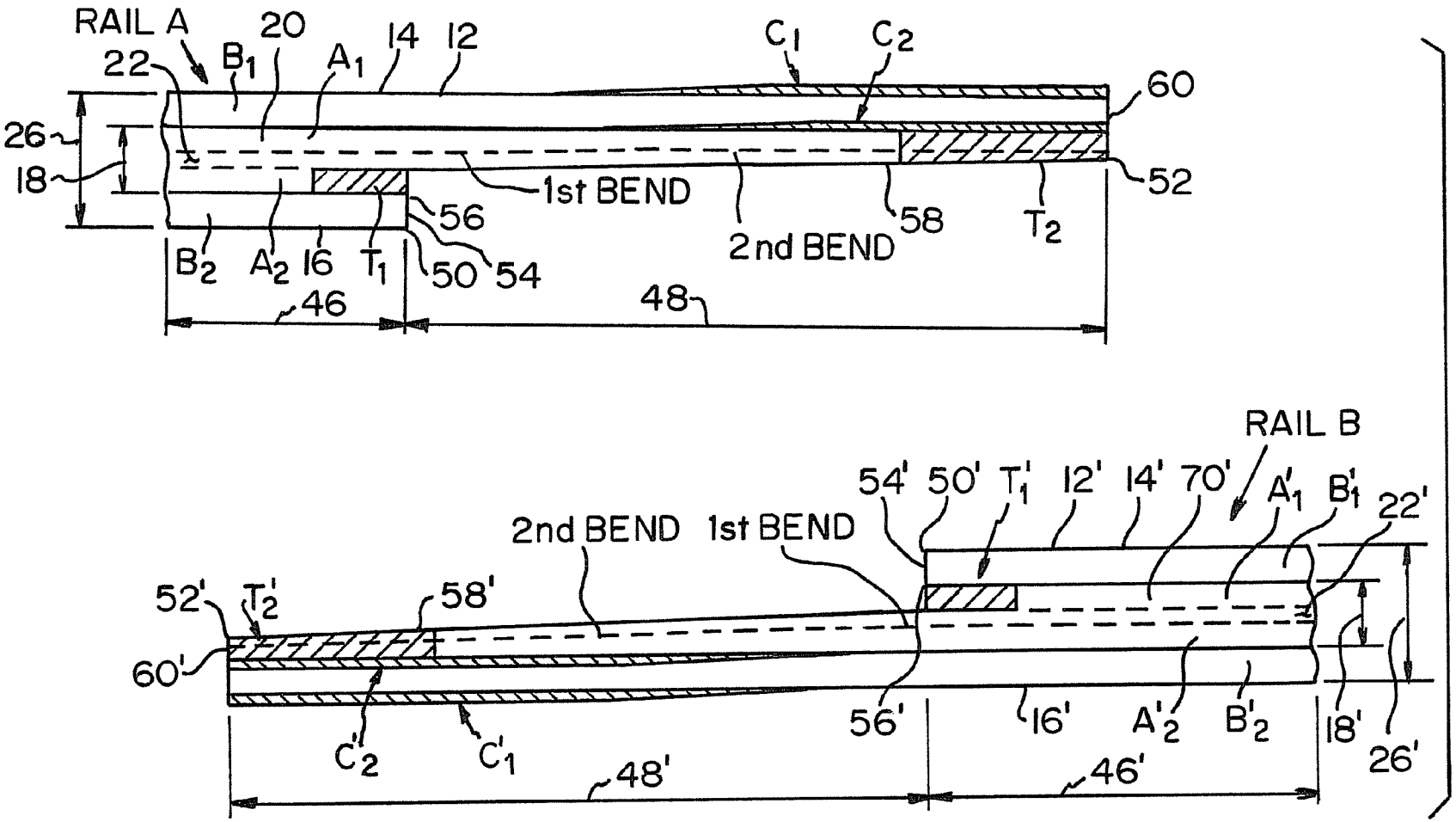
FIG. 5 is a top plan view of mating railroad rails shown in FIG. 4, after machining.

With continued reference to FIG. 4, the bending of Rails A and B is the first step prior to machining both of the rail sections to compliment each other as shown in FIG. 5. Each of the Rails A and B include two bends (referred to as a double bend). For references purposes, the first bend in Rail A is bent upward in a first direction X away from Rail B, and the first bend in Rail B is bent downward in a second direction X' away from Rail A. The second bend in Rail A is bent downward in the second direction X' toward Rail B and the second bend in Rail B is bent upward in the first direction X toward Rail A, such that the remaining rail sections after the second bend of Rails A and B are substantially parallel to each other.

Figure 6:
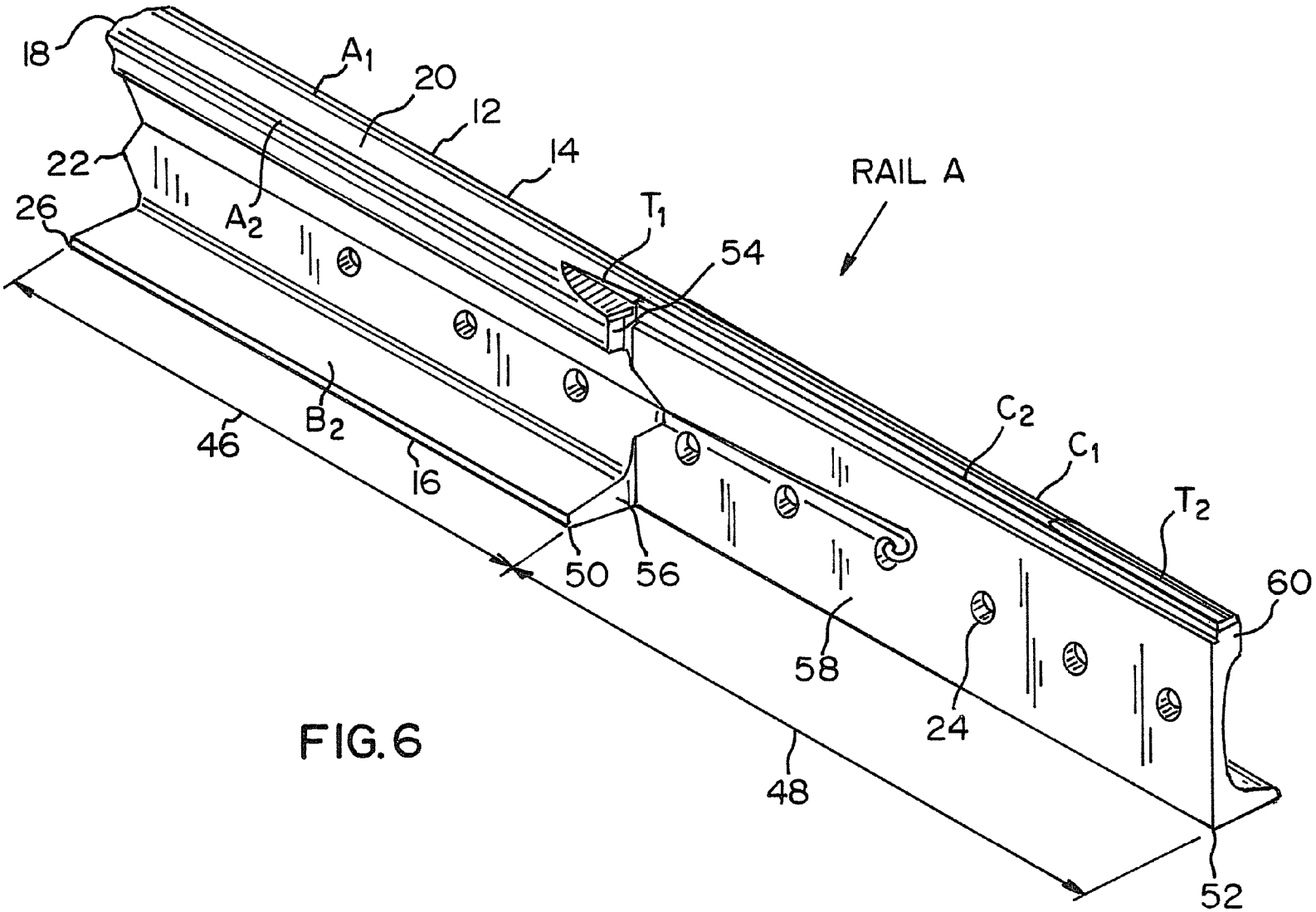
FIG. 6 is a perspective view of Rail A shown in FIG. 5.
Figure 7:
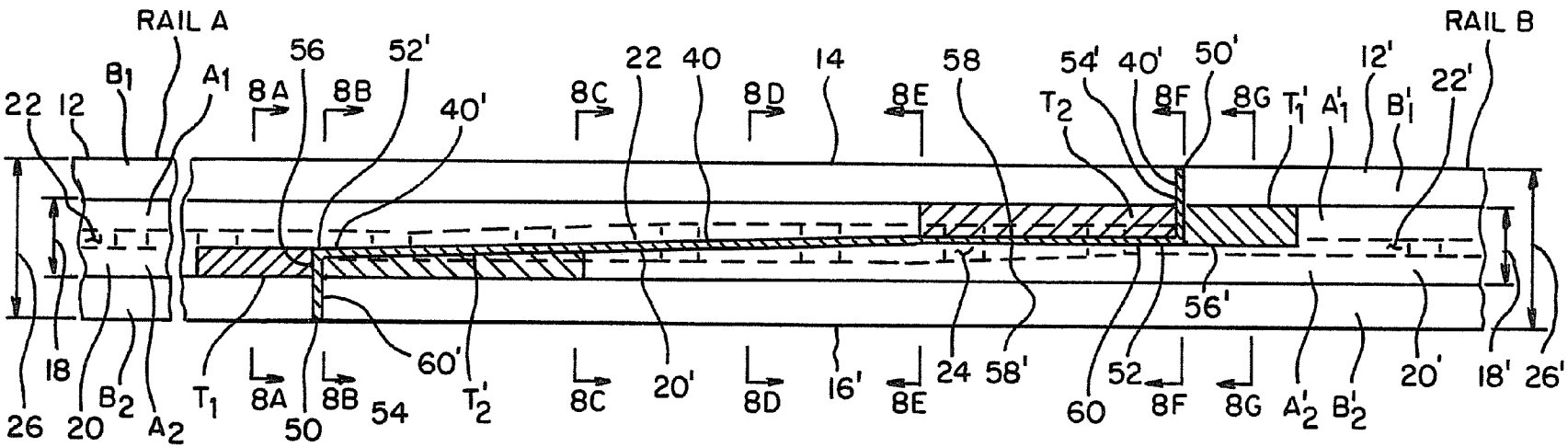
FIG. 7 is a top plan view of mating railroad rails, Rails A and B, joined together and with electrically-insulating material positioned therebetween.
Figure 8A:
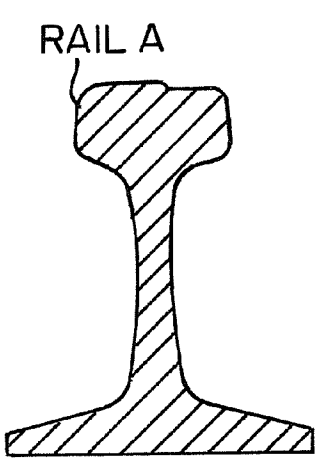
FIGS. 8A-8G show cross-sectional views of mating rail end sections, Rails A and B, taken along Sections 8A, 8B, 8C, 8D, 8E, 8F and 8G of FIG. 7.
Figure 8B:
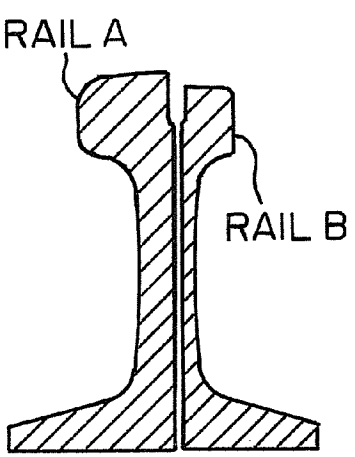
Figure 8C:
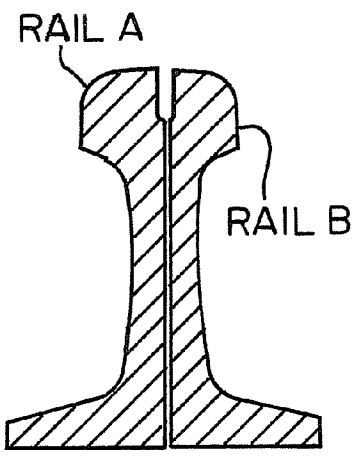
Figure 8D:
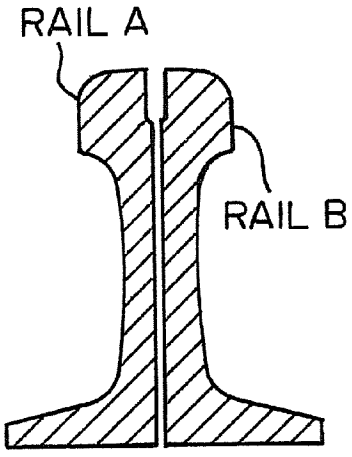
Figure 8E:
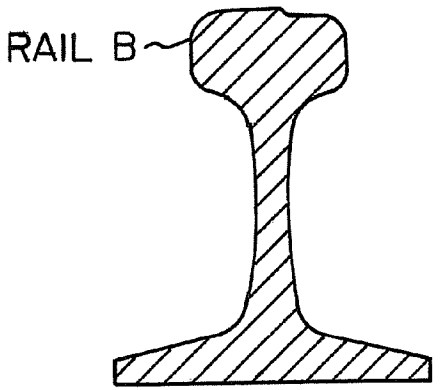
Figure 8F:
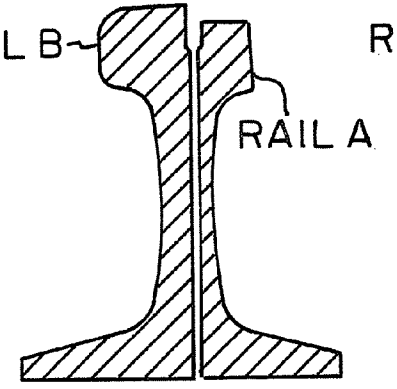
Figure 8G:
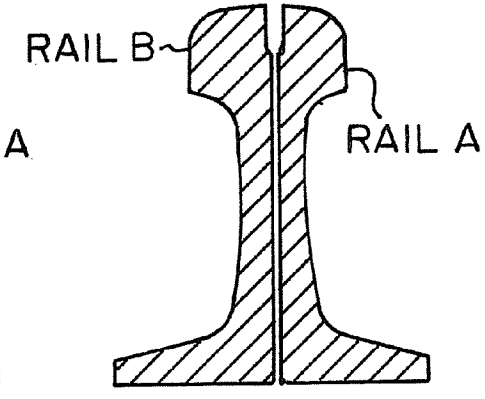

FIG. 5 illustrates mating railroad rails, Rails A and B, after they have been machine trimmed and tapered. Also shown in FIG. 5 are the unmachined bent Rails A and B in phantom over the machined Rails A and B. Predetermined portions of the first and second head portions $A_1$, $A_2$, the first and second base portions $B_1$, $B_2$ and the web section 22 of the body 12 of Rail A are removed. Accordingly, predetermined portions of the first and second head portions $A_1'$, $A_2'$, the first and second base portions $B_1'$, $B_2'$ and the web section 22' of the body 12' of Rail B are likewise removed. The head sections 18, 18' and base sections 26, 26' of Rails A and B are marked according to how the metal is machined trimmed and tapered. Referring to Rail A after machining as shown in FIGS. 5 and 6, Rail A includes a first section 46 and a second tapered section 48, wherein the second section 48 has a first end 50 and a second end 52. The first section 46 of Rail A is substantially similar to Rail A before machining occurred, except that a portion of the top surface 20 of the second head portion $A_2$ tapers downward toward the base section 26 as represented by reference $T_1$. The removal of the second head and base portions $A_2$, $B_2$ of Rail A after machining resulted in the formation of a ledge 54 having a first abutting surface 56 at the first end 50 of the second section 48 of Rail A. Further, a portion of the first base portion $B_1$ and the first head portion $A_1$ between the first end 50 and the second end 52 are trimmed, as shown in cross hatch as represented by references C1, C2, respectively. The head section 18 and web section 22 of the second section 48 of Rail A tapers from the first end 50 toward the second end 52, thus defining an intermediate abutting surface 58. The thickness of the web section 22 of the second section 48 of Rail A decreases from the first end 50 to the second end 52. A portion of the top surface 20 of the head section 18 tapers downward toward the second end 52 as represented by reference $T_2$, wherein the second end 52 defines a second abutting surface 60. Likewise, Rail B is machine trimmed and tapered in the same manner as Rail A in order for Rails A and B to compliment one another when joined, as shown in FIG. 7. Like corresponding reference numerals are used for like parts.

Figure 13:
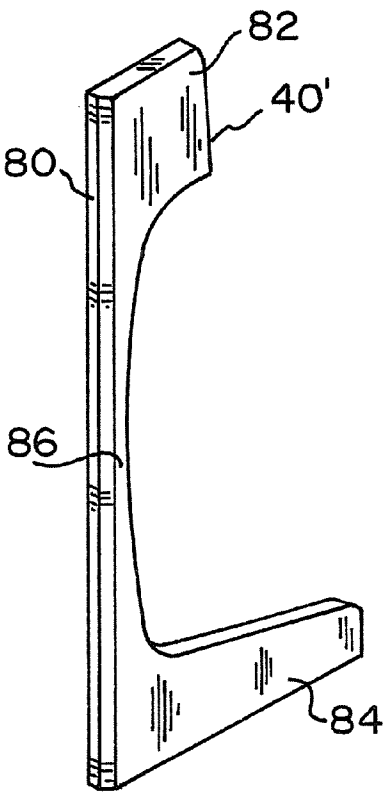
FIG. 13 is a perspective view of a piece of electrically-insulating material for an end post of the lap joint assembly shown in FIG. 9.
Figure 12D:
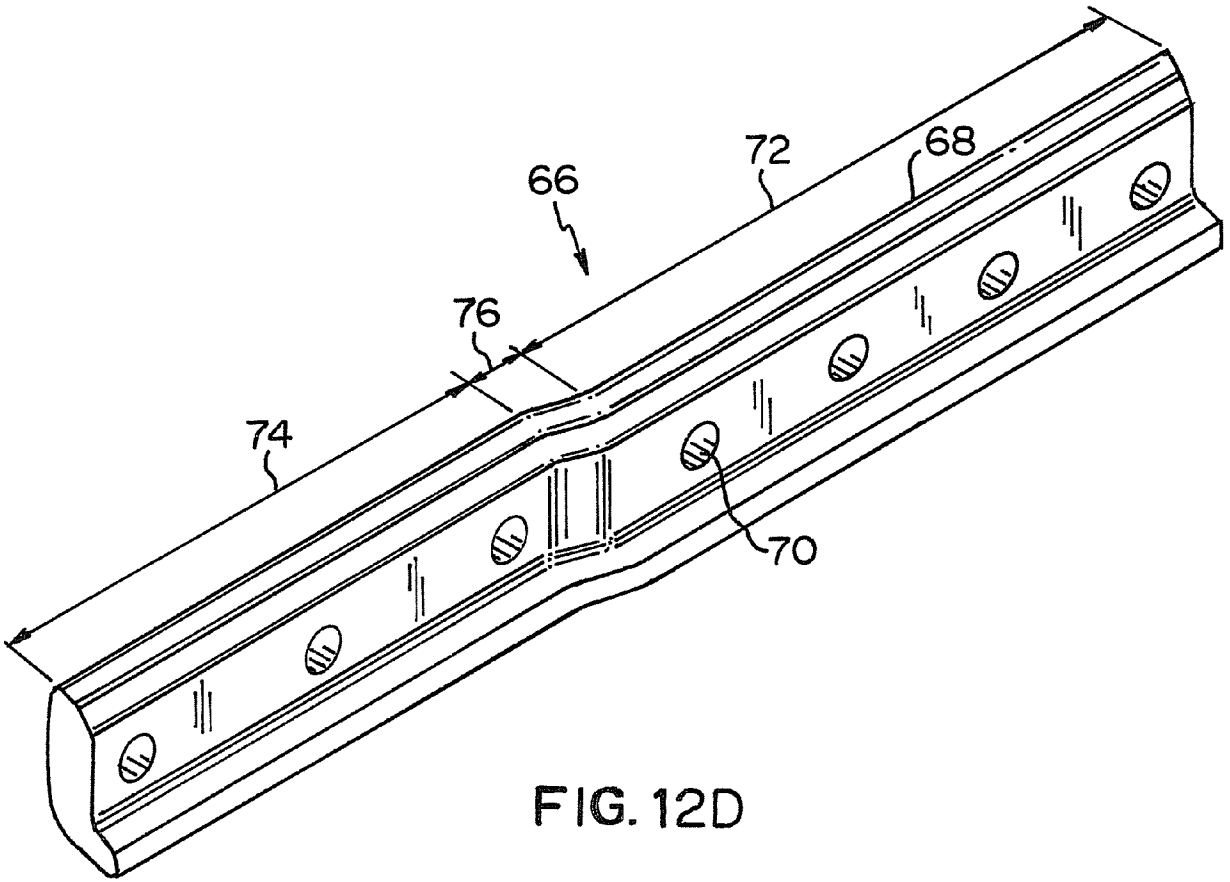
FIG. 12D is a perspective view of the rail joint bar shown in FIG. 12A.

FIG. 7 illustrates mating railroad rails, Rails A and B, after being joined to each other with electrically-insulating material 40, 40' (such as polyurethane) positioned between the abutting surfaces 56 and 60', 58 and 58', 60 and 56'. The insulating material 40, which is generally rectangular shaped, is positioned between the intermediate abutting surfaces 58 and 58'. Referring to FIGS. 6, 7 and 13, the insulating material 40', which corresponds, in general, to the shape of the second end 52 of Rail A, is positioned between the first and second abutting surfaces 56, 60' and 60, 56' of Rails A and B, respectively. Referring to FIG. 13, the insulating material 40' includes a body 80 defining an upper portion 82, a lower portion 84 spaced from the upper portion 82 and a web portion 86 connecting the upper portion 82 to the lower portion 84. The upper and lower portions 82, 84, extend in a same direction away from the web portion 86, thus defining a generally C-shaped profile, which is adapted to conform to the profile of first and second abutting surfaces 56, 60' and 60, 56' of Rails A and B, respectively.

FIGS. 8A-8G illustrates cross-sectional views of mating rail sections, Rails A and B, at Sections 8A, 8B, 8C, 8D, 8E, 8F and 8G of FIG. 7 after being joined. The profiles of Rails A and B change over the length of the joined rail sections taking along Sections 8A-8G. As can be seen, Section 8D ends at the midpoint of the mating rails, Rails A and B. As illustrated, Rail A is a more dominant part of the rail from Sections 8A-8C. After Section 8D, where both mating rails, Rails A and B, are essentially equal, the mirror image of FIG. 7 occurs, wherein Rail B is a more dominant part of the rail from Sections 8E-8G.

Figure 9:
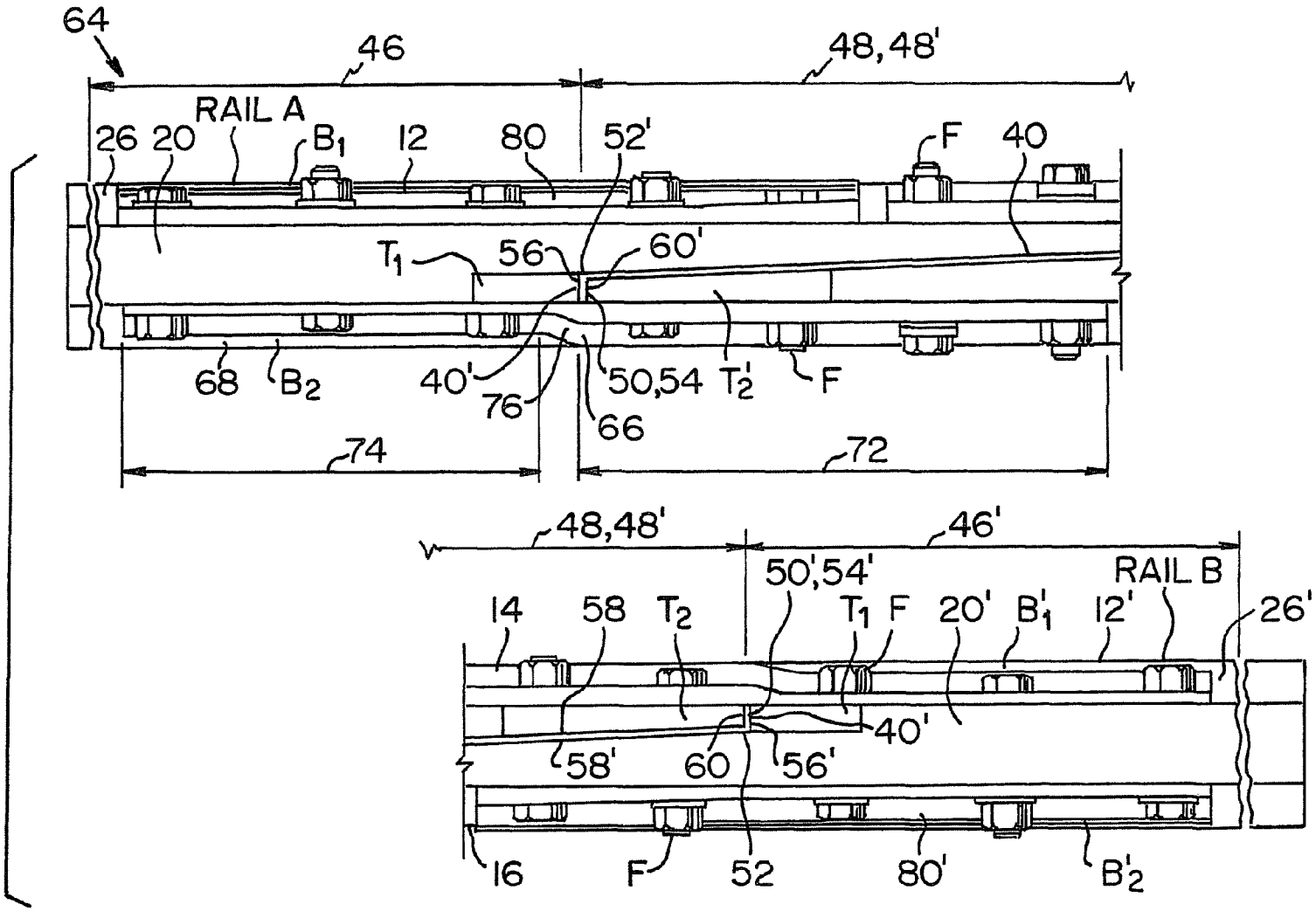
FIG. 9 is a top plan view of a lap joint assembly made in accordance with the present invention.
Figure 10:
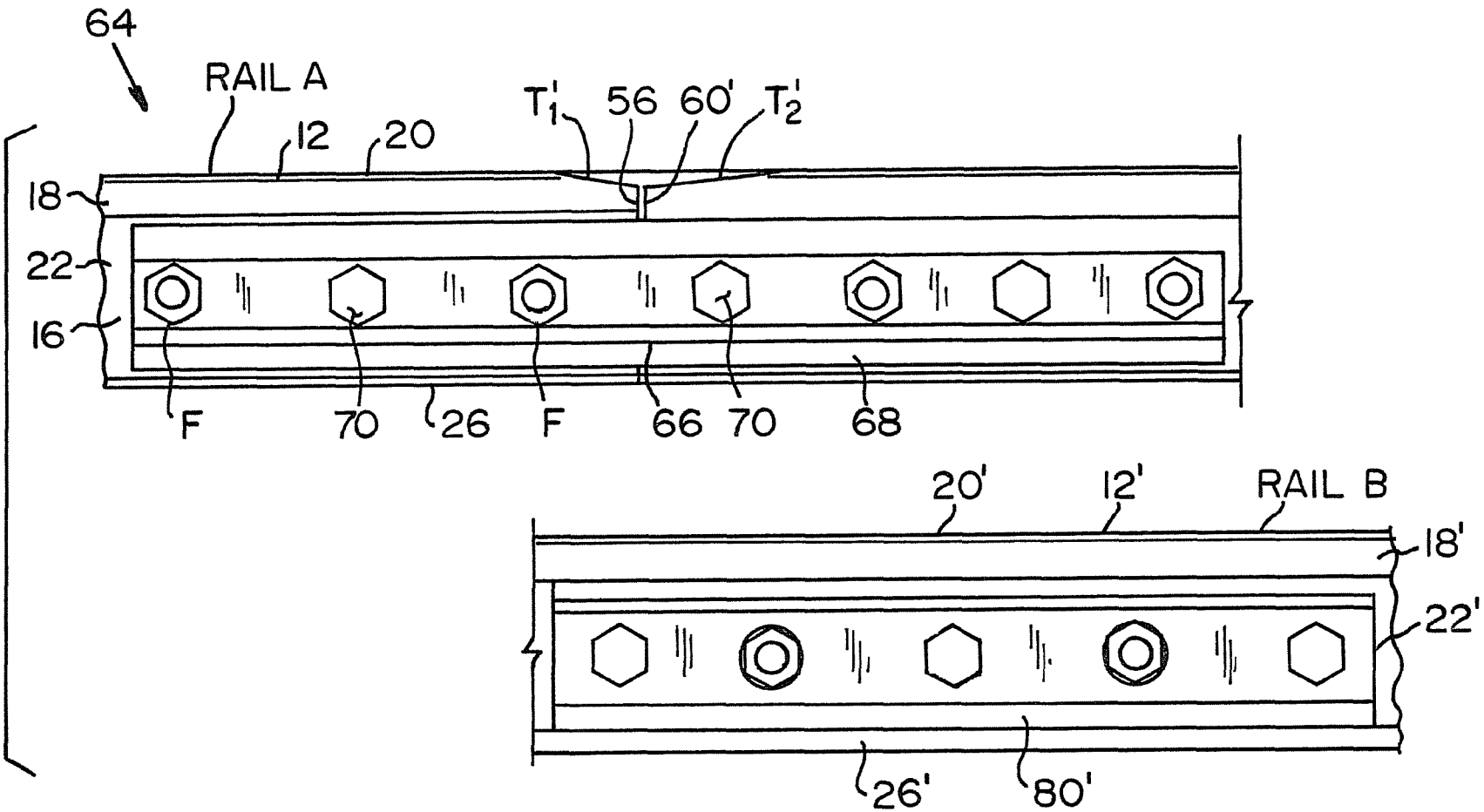
FIG. 10 is an elevational side view of the lap joint assembly shown in FIG. 9.
Figure 11:
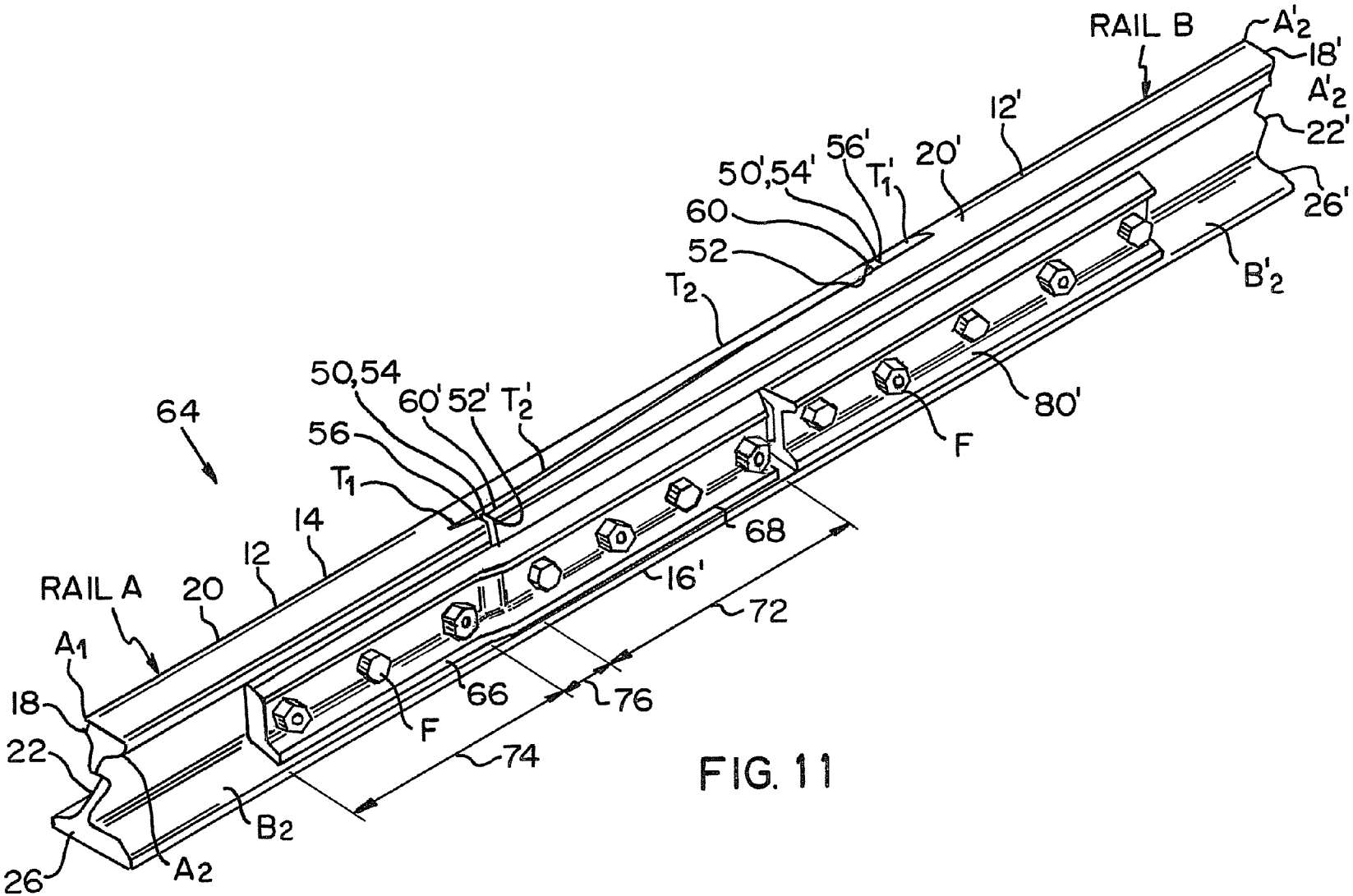
FIG. 11 is a perspective view of the lap joint assembly shown in FIG. 9.

FIGS. 9-11 show various views of a lap joint assembly 64 made in accordance with the present invention for electrically isolating two railroad rail sections. The assembly 64 includes mating rail sections, Rails A and B, joined to each other with electrically-insulating material 40, 40' sandwiched therebetween, and a pair of rail joint bars 66, 66' attached to each side 14, 16, respectively, of the mating rail sections for securing Rails A and B to each other, via fasteners F. FIGS. 12A-12D show a rail joint bar 66 having a longitudinal extending body 68 and defining a plurality of holes 70 for receiving fasteners.

Figure 2:
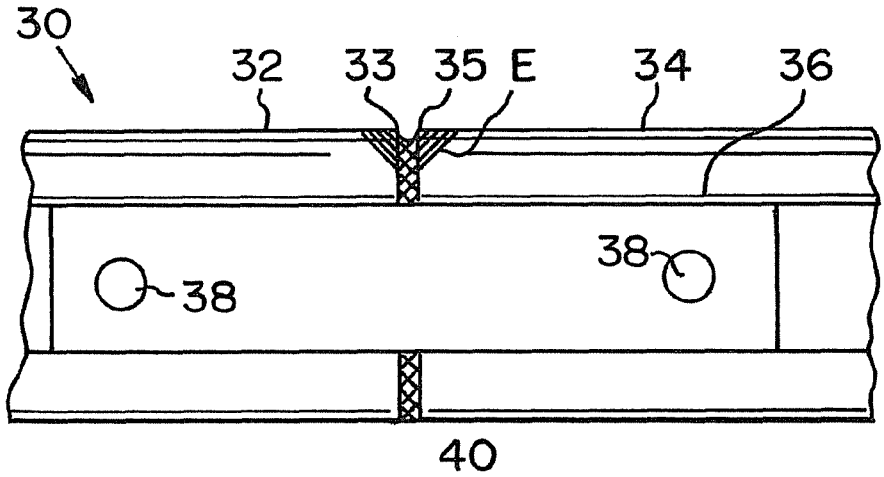
FIG. 2 (PRIOR ART)
FIG. 2 is an elevational side view of a prior art rail joint assembly for electrically isolating two adjoining railroad rail end sections.
Figure 3:
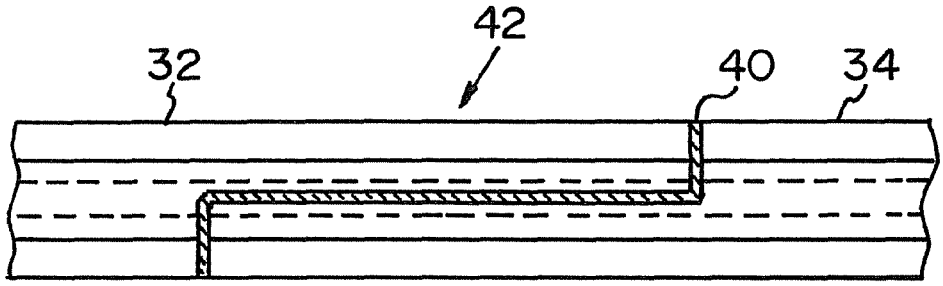
FIG. 3 (PRIOR ART)
FIG. 3 is a top plan view of a prior art rail joint arrangement for electrically isolating two adjoining railroad rail end sections.
Figure 12A:
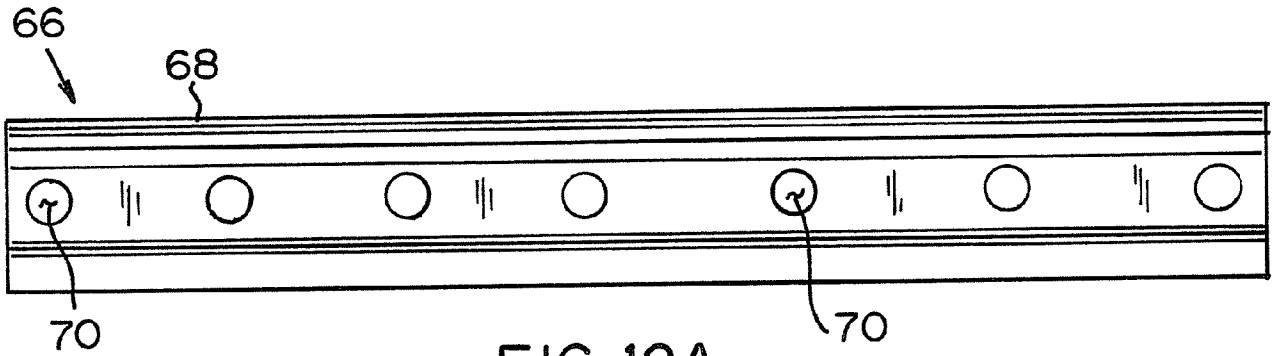
FIG. 12A is an elevational side view of a non-standard rail joint bar according to the present invention for use with the lap joint assembly shown in FIG. 9.
Figure 12B:
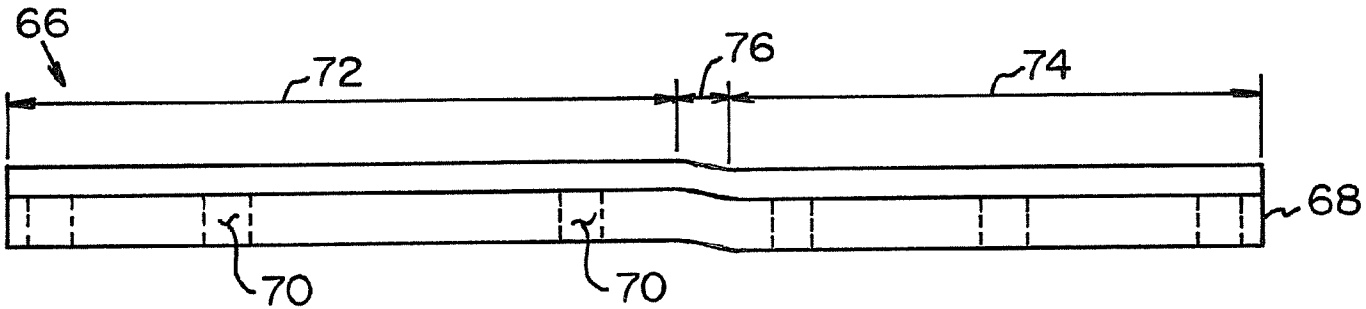
FIG. 12B is a top plan view of the rail joint bar shown in FIG. 12A.
Figure 12C:
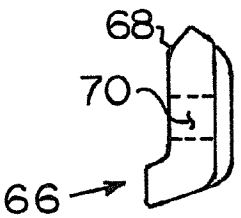
FIG. 12C is an end view of the rail joint bar shown in FIG. 12A.
Figure 14:
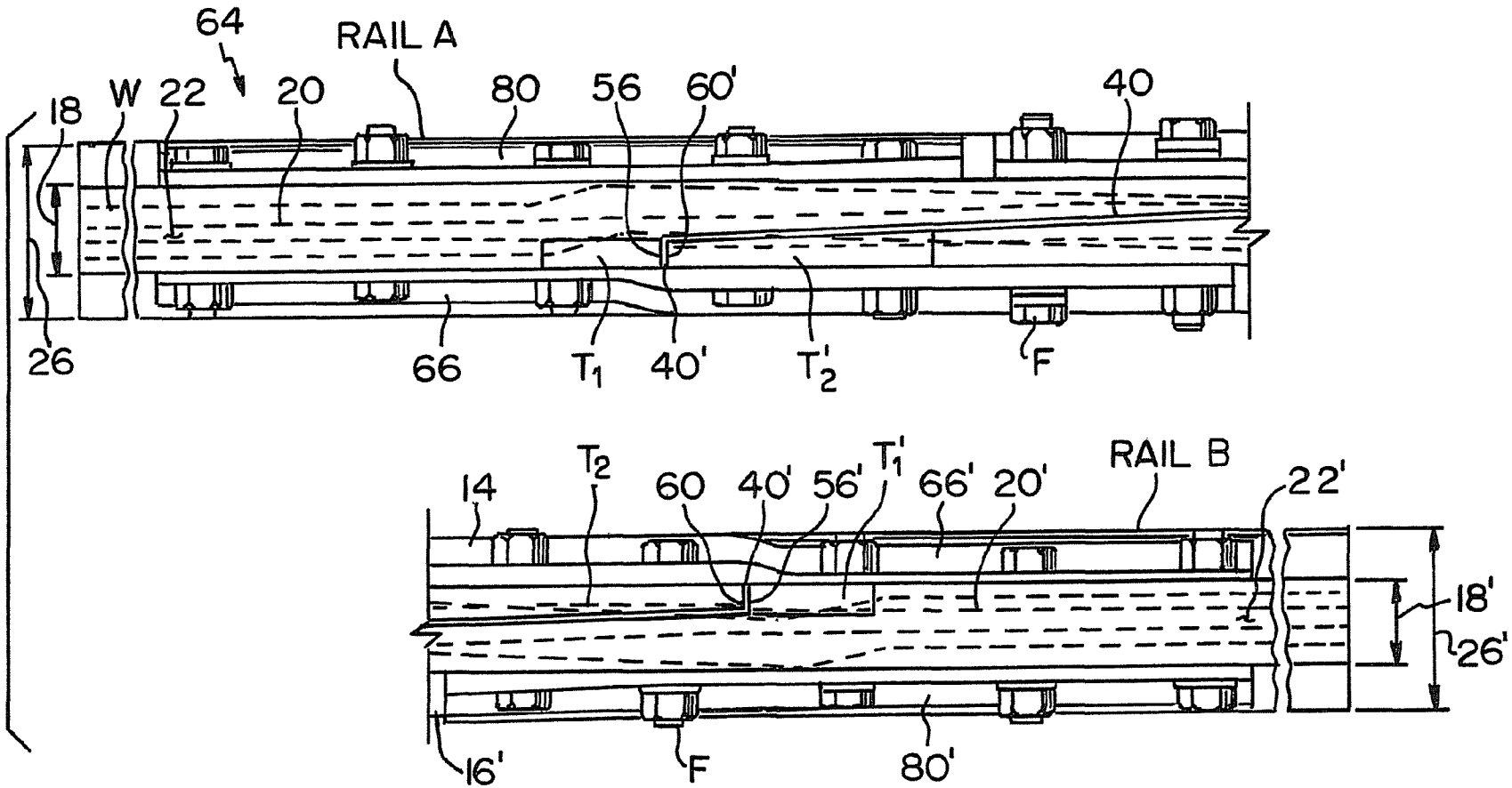
FIG. 14 is a top plan view of the lap joint assembly showing the position of traveling of train wheels on Rails A and B (shown in phantom).

Rail joint bar 66 is shaped similar to a standard prior art rail joint bar 36 as shown in FIG. 2, except that the body 68 is bent thus forming a first portion 72, a second portion 74 spaced from or offset from the first portion 72 and an intermediate portion 76 defined therebetween, wherein the first portion 72 and the second portion 74 are substantially parallel to each other as shown in FIG. 12B. Standard prior art rail joint bars are unbent, that is, they do not include the offset described above. The thickness of the joined web sections 22, 22' of Rails A and B (shown as dashed lines) is greater than the thickness of the web section of the individual railroad rails before machining as shown in FIG. 7. Referring to FIGS. 7, 9 and 11, this increase in thickness occurs at a point where the first abutting surface 56 of Rail A and the second abutting surface 60' of Rail B meet on the second side 16 of Rails A and B. The bend or intermediate portion 76 of the rail joint bar 66 is adapted or configured to accommodate the increase in thickness at this point, such that the second portion 74 is attached to the second side 16 of the first section 46 of Rail A, and the first portion 72 is attached to a portion of the second section 48' of Rail B. Likewise, the increase in web thickness occurs again at a point where the first abutting surface 56' of Rail B and the second abutting surface 60 of Rail A meet on the first side 14 of Rails A and B, wherein rail joint bar 66' is used for attachment. The rail joint bars 66, 66' may be attached to each side 14, 16 of the mating rail sections, Rails A and B, via fasteners F such as a nut and bolt arrangement. Further, rail joint bars 80, 80', similar to that as shown in FIG. 2, except the rail joints 80, 80' may have a slight bow and preferably are non-insulated, may optionally be used on opposing sides of rail joint bars 66, 66', respectively, for further securing mating rail sections, Rails A and B to each other. Referring to FIGS. 9 and 14, for example, the rail joint bar 66 is positioned on the second side 16 on a portion of joined Rails A and B, and rail joint bar 80 is positioned on the first side 14 of Rail A opposite rail joint bar 66. The rail joint bars 66, 66' and 80, 80' are preferably made of metal and bonded to rail using epoxy. Rail joint bars 66, 66' are electrically insulated from their respective railroad rails via an electrical insulator, such as a fiberglass sheath sandwiched between the rail joint bars 66, 66' and the respective rail ends. Rail joint bars 80, 80' do not need an insulated sheath. Because of the shape of rail joint bars 66, 66' and the large bond area, the strength of the lap joint assembly 64 is substantially increased. For example, it is believed that there is approximately 58% more bond strength (e.g., tensile strength) using bonded rail joint bars 66, 66' because of the overlap of the two rail ends. An adhesive can also be used to bond the electrically-insulating material 40, 40' that is positioned between the abutting surfaces 56 and 60', 58 and 58', 60 and 56' of Rails A and B, thus also increasing the strength of the lap joint assembly 64.

FIG. 14 shows the travel of the train wheels W (shown in phantom by dashed lines) on the top surfaces 20, 20' of the head sections 18, 18' of Rails A and B of the lap joint assembly 64. As the train travels from Rail A to Rail B, the tapered portions $T_1$, $T_2'$ of Rails A and B form a recess portion that causes the weight of train wheels to shift, primarily on Rail A where the web section 22 is thicker. Because the train wheels do not contact the tapered portions $T_1$, $T_2'$ or recess portion of each of the Rails A and B, the impact load of the train wheels shift to a portion where the web section is at its thickest. As the train wheels pass tapered portion $T_2'$ of Rail B, the load of the train wheels begins to shift to both Rails A and B. As the train wheel reach tapered portion $T_1$ of Rail A, the load of the train wheels shifts primarily to Rail B where the web section 22' is thicker. The lap joint assembly 64 results in a stronger and longer lasting rail joint assembly having a high Moment of Inertia, thereby reducing the end batter and deformation caused by the train wheels.

The present invention also provides for a method of manufacturing joined insulated rail sections, Rails A and B, that are machine tapered and trimmed, wherein the abutting rail sections are electrically isolated from one another. First, as previously described, Rails A and B are double bent to compliment each other. Second, the head sections 18, 18' and base sections 26, 26' of both rails are measured and marked according to how the metal is to be trimmed by a machine. Third, predetermined portions of the first and second head portions $A_1$, $A_2$, the first and second base portions $B_1$, $B_2$ and the web section 22 of the body 12 of Rail A are removed. Accordingly, predetermined portions of the first and second head portions $A_1'$, $A_2'$, the first and second base portions $B_1'$, $B_2'$ and the web section 22' of the body 12' of Rail B are likewise removed. Fourth, after trimming/tapering, an electrically-insulating material 40, such as a fiberglass sheath bonded with an epoxy is placed along the length of the intermediate abutting surfaces 58, 58'. Also, electrically-insulating material 40', such as a polyurethane or fiberglass sheath, is placed between abutting surfaces 56, 60' and 60, 56', respectively, of Rails A and B. The insulating material 40' can also be secured to the rail surfaces with epoxy. The thickness of the electrically-insulating material 40 and 40' may be the same or different. Lastly, Rails A and B are mechanically connected to each other and/or joint bars 66, 66' via fasteners F passing through bolt holes through each rail's respective web sections 22, 22'. The fasteners F can be any known fasteners in the art for joining two railroad rails together such as a nut and bolt arrangement. In addition, electrically-insulating material may also be positioned between the rail joint bars 66, 66' and Rails A and B for electrical isolation of the rail sections. As will be readily appreciated by those skilled in the art, the method of manufacturing and of assembling Rails A and B can repeat ad infinitum in order to provide railroad rails of varying lengths.

Further, it will be readily appreciated by those skilled in the art that modification may be made to the invention without departing from the concepts disclosed in the foregoing description. Accordingly, the particular embodiments described in detail herein are illustrative only and are not limiting to the scope of the invention, which is to be given the full breadth of the appended claims and any and all equivalents thereof.

The invention claimed is:

1. A railroad rail used to join two mating railroad rail end sections to each other, the railroad rail comprising:

a body defining a first section and a tapered second section having a first end and a second end, each section defines a head section, a web section depending from the head section, and a base section depending from the web section, wherein a predetermined portion of the base section, the web section and the head section of the second section is removed, thereby defining a first abutting surface at the first end, an intermediate abutting surface that tapers from the first end to the second end, and a second abutting surface at the second end, wherein the abutting surfaces of the railroad rail are configured to contact corresponding abutting surfaces of a complementary railroad rail when joined together, wherein the railroad rail is formed from a double bent railroad rail having a first bend and a second bend defined by a head section, a web section, and a base section of the double bent railroad rail.

2. The railroad rail as claimed in claim 1, wherein the first abutting surface of the railroad rail is configured to contact a corresponding second abutting surface of a complementary railroad rail and, wherein the second abutting surface of the railroad rail is configured to contact a corresponding first abutting surface of the complementary railroad rail when joined together.

3. The railroad rail as claimed in claim 1, wherein a predetermined portion of a top surface of the head section of the first section tapers downward toward the base section ending at the first end of the second section and, wherein a predetermined portion of a top surface of the head section of the second section tapers downward toward the base section ending at the second end of the second section such that when a complementary railroad rail is joined to the railroad rail, a recess portion is defined on the top surfaces thereof.

4. The railroad rail as claimed in claim 3, wherein the recess portion on the top surfaces of the joined railroad rails is configured to shift the impact load of a train wheel away from the recess portion and onto a portion where the web section of the joined railroad rails is at its thickest.

5. The railroad rail as claimed in claim 1, wherein the head section of the railroad rail has a top surface and includes a first head portion and a second head portion, the base section includes a first base portion and a second base portion on each side thereof, wherein predetermined portions of the first head portion, the second head portion, the first base portion, the second base portion and the web section are removed.

6. The railroad rail as claimed in claim 1, wherein said railroad rail comprises a standard tee railroad rail.

7. The railroad rail as claimed in claim 1, wherein said railroad rail is machine tapered and trimmed.

8. The railroad rail as claimed in claim 1, wherein the web section of each railroad rail comprises a plurality of slots adapted to receive fasteners.

9. The railroad rail as claimed in claim 1, wherein a thickness of the web section of the second section of the railroad rail decreases from the first end to the second end such that when a complementary railroad rail is joined thereto the web section of the joined railroad rails is greater than the thickness of the web section of each individual railroad rail before the predetermined portions are removed.

10. A railroad rail used to join two mating railroad rail end sections to each other, the railroad rail comprising:

a body defining a first section and a tapered second section having a first end and a second end, each section defines a head section, a web section depending from the head section, and a base section depending from the web section, wherein a predetermined portion of the base section, the web section and the head section of the second section is removed, thereby defining a first abutting surface at the first end, an intermediate abutting surface that tapers from the first end to the second end, and a second abutting surface at the second end, wherein the abutting surfaces of the railroad rail are configured to contact corresponding abutting surfaces of a complementary railroad rail when joined together, and wherein:

a predetermined portion of a top surface of the head section of the first section tapers downward toward the base section ending at the first end of the second section; and a predetermined portion of a top surface of the head section of the second section tapers downward toward the base section ending at the second end of the second section such that when a complementary railroad rail is joined to the railroad rail, a recess portion is defined on the top surfaces thereof.

11. A lap joint arrangement comprising:

two complementary mating railroad rails, wherein each railroad rail is formed from a double bent railroad rail having a first bend and a second bend defined by a head section, a web section, and a base section of the double bent railroad rail, and wherein each railroad rail comprises a body defining a first section and a tapered second section having a first end and a second end, each section defines a head section, a web section depending from the head section, and a base section depending from the web section, wherein a predetermined portion of the base section, the web section and the head section of the second section is removed, thereby defining a first abutting surface at the first end, an intermediate abutting surface that tapers from the first end to the second end, and a second abutting surface at the second end, wherein the abutting surfaces of a first railroad rail abuts against complementary abutting surfaces of a second railroad rail when the railroad rails are joined together.

12. The lap joint arrangement as claimed in claim 11, wherein the first abutting surface of the first railroad rail abuts against the second abutting surface of the second railroad rail, the second abutting surface of the first railroad rail abuts against the first abutting surface of the second railroad rail and the intermediate abutting surface of the first railroad rail abuts against the intermediate abutting surface of the second railroad rail when joined together.

13. The lap joint arrangement as claimed in claim 11, wherein a predetermined portion of a top surface of the head section of the first section of each railroad rail tapers downward toward the base section ending at the first end of the second section and, wherein a predetermined portion of a top surface of the head section of the second section tapers downward toward the base section ending at the second end of the second section, wherein recess portions are defined on the top surfaces thereof of the joined railroad rails, such that the impact load of a train wheel is shifted away from the recess portions and onto a portion where the web section of each of the railroad rails is at its thickest.

14. The lap joint arrangement as claimed in claim 11, wherein a thickness of the web section of the joined railroad rails is greater than the thickness of the web section of each individual railroad rail before removal of the predetermined portions of the railroad rails.

15. The lap joint arrangement as claimed in claim 14, wherein an increase in thickness of the web section of the joined railroad rails occurs where the first abutting surface of a first railroad rail and the second abutting surface of a second railroad rail meet on the second side and, wherein another increase in thickness of the web section occurs where the first abutting surface of the second railroad rail and the second abutting surface of the first railroad rail meet on the first side of the joined railroad rails.

16. The lap joint arrangement as claimed in claim 11, further comprising an electrically insulating material having a body defining an upper portion, a lower portion spaced from the upper portion and a web portion connecting the upper portion to the lower portion, wherein the upper portion and the lower portion extend in a same direction away from the web portion, thereby defining a generally C-shaped profile, the body of the electrically insulating material configured to conform to the profile of one of the first and second abutting surfaces of the first railroad rail.

17. A lap joint arrangement comprising:

two complementary mating railroad rails, each railroad rail comprises a body defining a first section and a tapered second section having a first end and a second end, each section defines a head section, a web section depending from the head section, and a base section depending from the web section, wherein a predetermined portion of the base section, the web section and the head section of the second section is removed, thereby defining a first abutting surface at the first end, an intermediate abutting surface that tapers from the first end to the second end, and a second abutting surface at the second end, wherein the abutting surfaces of a first railroad rail abuts against complementary abutting surfaces of a second railroad rail when the railroad rails are joined together, and wherein:

a predetermined portion of a top surface of the head section of the first section of each railroad rail tapers downward toward the base section ending at the first end of the second section; and a predetermined portion of a top surface of the head section of the second section tapers downward toward the base section ending at the second end of the second section, wherein recess portions are defined on the top surfaces thereof of the joined railroad rails, such that the impact load of a train wheel is shifted away from the recess portions and onto a portion where the web section of each of the railroad rails is at its thickest.

18. A lap joint assembly comprising:

a first railroad rail;

a second railroad rail joined to the first railroad rail, wherein each railroad rail having a first side and a second side comprises a body defining a first section and a tapered second section having a first end and a second end, the first section and the second section each defines a head section, a web section depending from the head section and a base section depending from the web section, the web section defines a plurality of slots for receiving fasteners and, wherein a predetermined portion of the base section, the web section and the head section of the second section is removed wherein:

the first end of the second section defines a first abutting surface, the second end of the second section defines a second abutting surface and the second section tapers from the first end to the second end thereby defining an intermediate abutting surface;

the first abutting surface of the first railroad rail abuts against the second abutting surface of the second railroad rail and the second abutting surface of the first railroad rail abuts against the first abutting surface of the second railroad rail;

an electrically-insulating material is positioned between each of the abutting surfaces of the joined railroad rails; and at least one rail joint bar having holes defined therein attached to the joined railroad rails.

19. The lap joint assembly as claimed in claim 18, further comprising a first rail joint bar attached to the first side and a second rail joint bar attached to the second side of the joined railroad rails, wherein a plurality of fasteners secure the rail joint bars to the joined railroad rails via a fastener passing through each hole in the first rail joint bar and the second rail joint bar and each slot in the joined railroad rails.

20. The lap joint assembly as claimed in claim 18, wherein an increase in thickness of the web section occurs where the first abutting surface of the first railroad rail and the second abutting surface of the second railroad rail abut on the second side thereof and, wherein another increase in thickness of the web section occurs where the first abutting surface of the second railroad rail and the second abutting surface of the first railroad rail abut on the first side thereof of the joined railroad rails.

21. The lap joint assembly as claimed in claim 20, wherein the rail joint bar comprises an offset rail joint bar having a longitudinal extending body that is bent thus forming a first portion, a second portion spaced from the first portion and an intermediate portion defined therebetween, wherein the intermediate portion of the rail joint bar is configured to accommodate the point where the increase in thickness of the web section of the joined railroad rails occurs.

22. The lap joint assembly as claimed in claim 21, further comprising a non-insulated rail joint bar attached to the joined railroad rails, wherein the non-insulated rail joint bar is positioned on an opposite side of the offset rail joint bar.

23. The lap joint assembly as claimed in claim 18, further comprising a plurality of rail joint bars for securing the joined railroad rails to each other.

24. The lap joint assembly as claimed in claim 18, wherein the rail joint bar is made of a unitary piece of forged or rolled metal.

25. A method of manufacturing an insulating lap joint assembly comprising:

providing two spaced apart mating railroad rails that are double bent to conform in spatial alignment with one another;

machining the two spaced apart mating railroad rails to complement each other, wherein each railroad rail end section comprises a body defining a first section and a tapered second section having a first end and a second end, each section defines a head section, a web section depending from the head section, and a base section depending from the web section, wherein a predetermined portion of the base section, the web section and the head section of the second section is removed, thereby defining a first abutting surface at the first end, an intermediate abutting surface that tapers from the first end to the second end, and a second abutting surface at the second end, wherein the abutting surfaces of a first railroad rail abuts against the abutting surfaces of a complementary second railroad rail when the railroad rails are joined together;

placing electrically-insulating material between the abutting surfaces of the two machined railroad rails; and attaching the machined railroad rails to one another, wherein a first bend in the first railroad rail is bent upward in a first direction away from the second railroad rail, and a first bend in the second railroad rail is bent downward iii a second direction away from the first railroad rail, a second bend in the first railroad rail is bent downward in the second direction toward the second railroad rail and a second bend in the second railroad rail is bent upward in a first direction toward the first railroad rail, such that any remaining rail sections after the second bend of both the first and second railroad rails are substantially parallel to each other.

26. The method as claimed in claim 25, wherein the electrically-insulating material conforms to the shape of the abutting surfaces of the railroad rails.

27. A method for manufacturing a railroad rail end section for use in an insulating lap joint assembly, the method comprising:

providing a railroad rail having a body and defining a head section, a web section depending from the head section, and a base section depending from the web section;

bending the head section, web section, and base section of the railroad rail such that the railroad rail has a first bend in a first direction and a second bend spaced apart from the first bend wherein the second bend is in an opposite direction from the first bend thereby forming a double bent railroad rail;

machining the double bent railroad rail thereby forming a first section and a tapered second section having a first end and a second end, wherein a predetermined portion of the base section, the web section and the head section of the second section is removed such that the first end defines a first abutting surface, the second end defines a second abutting surface and an intermediate abutting surface that tapers from the first end to the second end is defined therebetween; and trimming the machined railroad rail, wherein a predetermined portion of a top surface of the head section of the first section tapers downward toward the base section ending at the first end of the second section and, wherein a predetermined portion of a top surface of the head section of the second section tapers downward toward the base section ending at the second end of the second section.

* * * * *

UNITED STATES PATENT AND TRADEMARK OFFICE

CERTIFICATE OF CORRECTION

PATENT NO. : 8,113,441 B2
APPLICATION NO. : 11/900635
DATED : February 14, 2012
INVENTOR(S) : W. Thomas Urmson, Jr. et al.

It is certified that error appears in the above-identified patent and that said Letters Patent is hereby corrected as shown below:

Column 10, Line 48, Claim 25, delete "iii" and insert -- in --

Signed and Sealed this
Twenty-fourth Day of April, 2012

David J. Kappos

David J. Kappos
*Director of the United States Patent and Trademark Office*